United States Patent [19]

Tanaka et al.

[11] Patent Number: 4,783,681

[45] Date of Patent: Nov. 8, 1988

[54] IMAGE PROCESSING SYSTEM

[75] Inventors: Sohei Tanaka, Yokohama; Toshio Honma, Tokyo, both of Japan

[73] Assignee: Canon Kabushiki Kaisha, Tokyo, Japan

[21] Appl. No.: 12,606

[22] Filed: Feb. 9, 1987

Related U.S. Application Data

[63] Continuation of Ser. No. 565,190, Dec. 23, 1983, abandoned.

[30] Foreign Application Priority Data

| | | | |
|---|---|---|---|
| Dec. 28, 1982 | [JP] | Japan | 57-227639 |
| Dec. 28, 1982 | [JP] | Japan | 57-227640 |
| Dec. 28, 1982 | [JP] | Japan | 57-227641 |
| Dec. 28, 1982 | [JP] | Japan | 57-227642 |
| Dec. 28, 1982 | [JP] | Japan | 57-227643 |

[51] Int. Cl.[4] ..... G03G 15/00; G03G 21/00

[52] U.S. Cl. ..... 355/14 R; 355/3 R; 355/24; 355/46

[58] Field of Search ..... 355/3 R, 4, 23, 24, 355/26, 46, 14 R

[56] References Cited

U.S. PATENT DOCUMENTS

| | | | |
|---|---|---|---|
| 3,548,783 | 12/1970 | Knapp | 355/3 R X |
| 4,134,341 | 1/1979 | Weigele et al. | 355/14 R X |
| 4,167,322 | 9/1979 | Yano et al. | 355/3 R |
| 4,236,813 | 12/1980 | Levine | 355/14 R |
| 4,275,879 | 6/1981 | Yamashita et al. | 355/14 R X |
| 4,350,439 | 9/1982 | Tanioka et al. | 355/14 R X |
| 4,405,225 | 9/1983 | Perrault | 355/14 R |
| 4,537,497 | 8/1985 | Masuda | 355/14 R |
| 4,579,446 | 4/1986 | Fujino et al. | 355/24 |

*Primary Examiner*—Fred L. Braun

*Attorney, Agent, or Firm*—Fitzpatrick, Cella, Harper & Scinto

[57] ABSTRACT

An image processing system contains a plurality of recording units, each for recording an image on a separate recording material, which are coupled together so that a recording material on which an image is recording on a first recording unit is detected and fed to the next recording unit so as to receive a second image from the second unit and thereby form an overlay on a single recording material.

29 Claims, 7 Drawing Sheets

IMAGE PROCESSING SYSTEM

This is a continuation of application Ser. No. 565,190 filed Dec. 23, 1983, now abandoned.

BACKGROUND OF THE INVENTION

1. Field of the Invention

The present invention relates to an image processing system in which plural units for image formation on a recording material, such as copiers or facsimile devices, are controlled in their combination to achieve various image processing operations.

2. Description of the Prior Art

In case of producing a document for example by combining plural original documents, it has conventionally been necessary to overlay sentences or drawings plural times on a recording sheet by means of one or plural copying machines. For this reason, in such conventional apparatus, the operator has to conduct complicated manual copying operations, such as plural actuations of copy button or manual transfer of copying sheets, after a copying operation to the manual insertion slot. Also a multi-color copying has only been achieved by an expensive color copier. Multi-color copying is possible by a similar procedure if plural units of relatively inexpensive monocolor copiers are used with developers of respectively different colors and if the original is separated into different colors, but such process will require extremely cumbersome operations to the operator in the same manner as explained above.

In order to avoid such complicated operation there have been proposed a copier with an editing function, for example a color copier with ordinary three-color overlaying process, in which a control unit overlays the image information of plural originals on a photosensitive drum or in a memory device and then transfers such information at a time onto the recording sheet, or a copier capable of forming a latent image on a photosensitive drum at a time by optically editing plural originals, in which for example a control unit controls plural optical systems to focus plural images onto a photosensitive drum, but such copiers are inevitably large and considerably expensive.

In consideration of such present situation where the price of a copier of advanced function as explained above is almost equal to the sum of prices of plural simple copiers, it will be convenient if the above-described editing or multi-color copying can be achieved by connecting plural units of inexpensive copiers through simple link mechanisms, since such structure will simplify the required copying operation and reduce the cost in comparison with the prior copier with advanced function, and still allow independent use of each copier unit when required.

However, in such structure, an unsatisfactory linkage, for example a curved linkage, may lead to skewed or swaying advancement of the recording sheets, eventually resulting in sheet jamming. Also unmatched timings between the copier units will result in aberration of characters or images on the come or is sheet jamming. Furthermore, such abnormality as sheet jamming may lead to a major trouble unless certain copier units are appropriately stopped.

Furthermore, even in such linked state, a complicated procedure will be required if the operating panels of different copier units have to be manipulted, and such linked structure will be unable to perform normal combined function if each copier unit starts an independent operation by an erroneous manipulation of the operating panel thereof.

Furthermore, in such linked structure of plural copier units, the timing control of sheet feeding with ordinary sheet feeding rollers and registration rollers is difficult in a downstream copier unit receiving the recording sheets from an upstream copier unit, since the recording sheet may still be in the fixing station of the upstream copier unit, and such failed sheet feeding control may result in sheet jamming.

Furthermore, in such linked structure, each copier unit in said structure has to be appropriately stopped for safety in case of an abnormality such as sheet jamming, but such stoppage may result in a significant loss of recording sheets since the recording sheets present in the copier units downstream of the failed copier unit are in normal state.

SUMMARY OF THE INVENTION

In consideration of the foregoing, an object of the present invention is to provide an image processing system allowing independent copying control for each of plural image processing apparatus in case they are independently used, and allowing, in case said plural apparatus are used in connected state along the transport path of the recording sheet, one of said plural apparatus to control the others thereby facilitating image processing such as the aforementioned image editing.

Another object of the present invention is to provide an image processing system composed of mutually connectable plural image processing apparatus wherein said plural apparatus are capable of mutual inspection of the firm connections among said apparatus and or mutual control for terminating the function of said apparatus for safety in case of an abnormality thereby avoiding sheet skewing or sheet jamming, preventing unmatched timing among said apparatus and appropriately stopping each apparatus in case of an abnormality.

Still another object of the present invention is to provide an image processing system composed of mutually connectable plural image processing apparatus, which is adapted, in case said plural apparatus are used in connected state, to prohibit the entry of input signals through input keys such as the copy start button or the copy number keys in the operating panels of said plural apparatus except the first apparatus, thereby simplifying the control procedure and preventing erroneous function in such connected state.

Still another object of the present invention is to provide an image processing system composed of mutually connectable plural image processing apparatus, wherein in each of the downstream apparatus receiving the recording sheets already subjected at least once to copying operation, the sheet feeding is conducted not by the feeding rollers of said apparatus but by a part of the sheet discharging means of the immediately preceding apparatus, and a timing signal is supplied from said part of the sheet discharging means for controlling the registration rollers of the first-mentioned downstream apparatus, thereby achieving smooth sheet feeding operation.

Still another object of the present invention is to provide an image processing system composed of mutually connectable plural image processing apparatus, wherein, in case of an abnormality in the course of operation in the connected state, the apparatus positioned downstream of the failed apparatus are maintained in operable state until the currently ongoing copying operation is completed while those positioned upstream of said failed apparatus are immediately stopped with the recording sheets therein, thereby minimizing the loss of recording sheets and improving the efficiency of operation.

The foregoing and still other objects of the present invention, and the advantages thereof will become fully apparent from the following description.

DETAILED DESCRIPTION OF THE PREFERRED EMBODIMENTS

Now the present invention will be clarified in detail by the following description which is to be taken in conjunction with the attached drawings.

Figure 1:
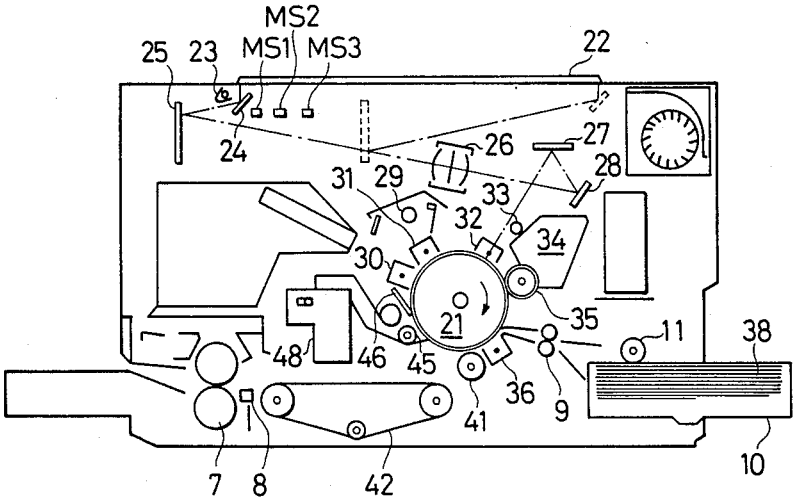
FIG. 1 is a cross-sectional view of a copier in which the present invention is applicable.

FIG. 1 shows an example of the structure of a copier in which the present invention is applicable.

A photosensitive drum 21, surfacially provided with a seamless photosensitive member of three-layered structure utilizing CdS as the photosensitive element, is rotatably supported and is rotated in a direction indicated by an arrow by means of an unreprsented main motor in response to the actuation of a copy start key.

After the rotation of said drum 21 by a predetermined amount, an original placed on a carrier glass 22 is illuminated by a lamp 23 constructed integral with a first scanning mirror 24, and the light reflected from said original is scanned by said first scanning mirror 24 and a second scanning mirror 25, which are moved with a speed ratio of 1:½ to maintain a constant optical path length in front of a lens 26.

Said reflected light is guided through the lens 26, a third mirror 27 and a fourth mirror 28 and focused in an exposure station onto the drum 21.

The drum 21 is at first exposed to the light from a pre-exposure lamp 29 simultaneously with charge elimination by a pre-eliminator 30, then is charged, for example positively, by corona discharge from a primary charger 31, and is slit exposed, in said exposure station, to the light from the lamp 23 reflected by the original.

Simultaneously charge elimination with an AC corona discharge or a DC corona discharge of a polarity opposite to that of the primary charging is conducted by a secondary charger 32, and a uniform allover exposure is thereafter given by an overall exposure lamp 33 to form an electrostatic latent image of an elevated contrast on the drum 21. Said latent image is subsequently rendered visible as toner image by a developing roller 35 in a developing station 34, and said toner image is transferred onto a recording sheet by means of a transfer charger 36.

The recording sheet 38 in a cassette 10 is advanced into the apparatus by a feeding roller 11 . and forwarded toward the photosensitive drum 21 with an exact timing controlled by registration rollers 9 in such a manner that the leading end of the latent image coincides with the leading end of the sheet at the image transfer station.

Then the toner image on the drum 21 is transferred onto the recording sheet during passage thereof between the transfer charger 36 and the drum 21.

After said image transfer, the recording sheet is separated by a separating roller 41 from the drum 21, then transported by a conveyor belt 42 through a sheet discharge sensor 8 to fixing rollers 7 where the image is fixed by pressure and heat, and is finally discharged from the apparatus.

The drum 21 after the imaqe transfer is further rotated, and the surface thereof is cleaned by a cleaning station composed of a magnet roller 45 and an elastic blade 46. The toner thus recovered is collected in a used toner container 48, and the drum proceeds to a next imaging cycle.

There are also provided sensors MS1, MS2 and MS3 to be adtuated by the optical system, or the first scanning mirror 24. The sensor MS1 detects that the optical system is located at the home position. Also the sensors MS2 and MS3 effect position detection for generating timing control signals for controlling the forward and reverse motion of the optical system and the feeding and registration of the recording sheet.

Figure 2:
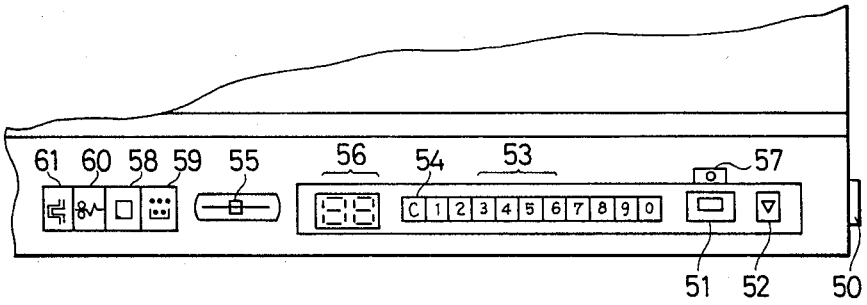
FIG. 2 is a plan view of an operation panel of the copier shown in FIG. 1.

FIG. 2 is a plan view of an operation panel of the copier shown in FIG. 1, wherein provided are a main power switch 50; a copy start key 51; a stop key 52 for interrupting a continuous copying operation; numeral keys 53 for entering a set copy number into a memory; a clear key 54 for clearing said memory; a copy density adjusting lever 55; a 7-segment display unit 56 for indicating the number stored in the memory; a waiting lamp 57 to be lighted until the fixing rollers 7 reach a temperature suitable for image fixation; an indicator lamp 58 for indicating the absence of cassette or absence of recording sheet in the cassette; an indicator lamp 59 to be lighted when the used toner container 48 is full; and indicator lamp 60 to be lighted when a recording sheet is jammed in the apparatus; and an indicator lamp 61 for indicating an abnormality in the coupling of copier units to be explained later. The numeral keys and the clear key are disabled during a sheet jam state but are enabled during the waiting state.

The 7-segment display unit 56 indicates "1" when the power switch 50 is turned on, even during the waiting state, then displays a number stepwise decreased from the set copy number upon completion of each copying cycle, further displays the set copy number again upon completion of a continuous copying cycles of the set copy number, and displays "1" again if the following copying operation is not commenced within 30 seconds thereafter. Consequently a single copying operation can be initiated without number setting by the numeral keys, and the copying operation of a same set copy number can be easily repeated.

The waiting indicator 57, which is controlled by the actuation of the power switch 50, is continuously lighted when the temperature of the fixing rollers is still higher than the minimum fixing temperature, namely when the power switch 50 is turned on shortly after it was switched off, but said indicator is intermittently lighted if the temperature of the fixing rollers is below said fixing temperature. Also it is lighted upon lapse of a predetermined waiting time after the fixing rollers reach the fixing temperature. When the power switch is turned off, said indicator is completely extinguished to indicate the turned-off state of the power supply. Furthermore, in case the copy key is actuated after the lapse of the waiting time, said indicator is intermittently lighted with an interval longer than in the waiting time, until the copying cycle enters the post-rotation phase. In this manner a single waiting indicator can indicate a power-on state, a waiting state in which copying operation is disabled, a copy enabled state and a contination of the copying cycle, and it is rendered possible to minimize the number of indicators and to reduce the cost of the apparatus.

The overflow indicator 59 is continuously lighted in case of an overflowing state of the container 48 and of toner deficiency in a developer container 34. It is also possible to adopt intermittent light and continuous lighting respectively in the former and the latter cases. In a similar manner the indicator 59 may be intermittently lighted in case of absence of recording sheet in the cassette and continuously lighted in case of absence of the cassette.

Upon detection of toner deficiency in the hopper 34 or of overflowing state of the used toner container 48 in the course of a continuous copying operation for a set copy number selected by the numeral keys, said copying operation is continued until completion but any subsequent copying operation is disabled. In this manner the alarm is immediately indicated upon said detection but the interruption of copying operation is delayed in order to prevent substantial loss in the copying speed, since such toner deficiency or toner overflow will not give rise to an immediate deterioration of the image quality or an immediate smearing of the apparatus. On the other hand the copying operation is immediately interrupted in case of a sheet jamming for the purpose of safety. In case of the actuation of the stop key or the detection of absence of recording sheet or cassette, the copying cycle conducted at said detection is continued until completion and succeeding copying cycle is disabled.

Figure 3A:
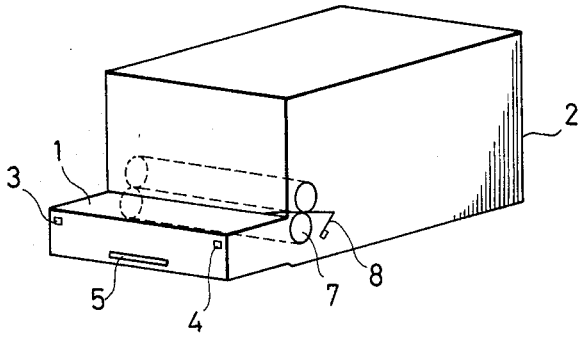
FIGS. 3A and 3*b* are perspective views, respectively seen from the sheet discharging side and the sheet introducing side, of an example of the structure of the image processing apparatus shown in FIG. 1.
Figure 3B:
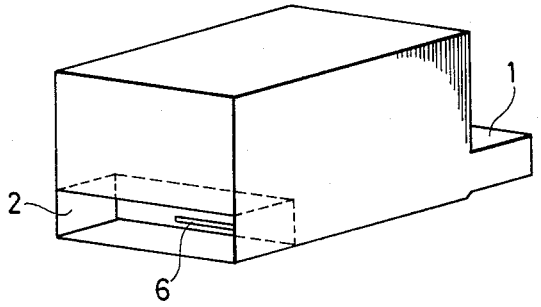

FIGS. 3A and 3B are views, seen from different directions, of an example of the image processing apparatus, for example a copier, shown in FIG. 1, wherein shown are a male (projecting) coupling 1 which is formed on said apparatus in a shape substantially same as that of the cassette 10 shown in FIG. 1 and which is to engage with female (recessed) coupling 2 of a similar apparatus corresponding to a part for inserting the cassette 10, and sensors 3, 4 composed of a pair of push switches for detecting the coupling state. Both apparatus are identified to be completely coupled and to be straightly positioned in the horizontal direction if said switches 3, 4 are both closed. A connector receptacle 5 provinced in the male coupling 1 engages with a connector plug 6 provided in the female coupling 2 of said another apparatus for transmitting data and control signals between the coupled apparatus. Fixing rollers 7 for image fixing discharges an unrepresented recording sheet to the upper face of the male coupling 1, and a sheet discharge sensor 8 composed of a microswitch detects the recording sheet passing through said fixing rollers 7.

Figure 4:
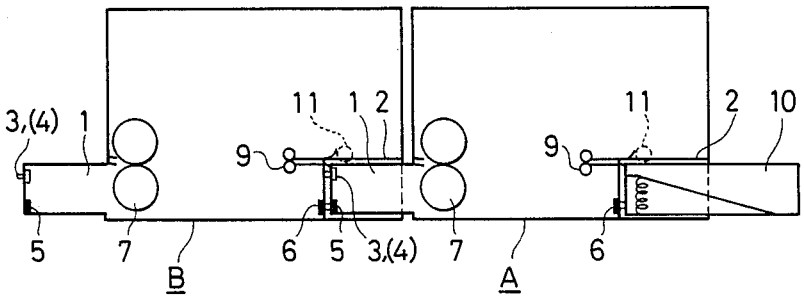
FIG. 4 is a cross-sectional view wherein two units of the apparatus shown in FIGS. 3A and 3B are connected.

FIG. 4 shows a state in which two units of the apparatus shown in FIG. 1 are connected by coupling the coupling 1 at the exit side of a unit A with the coupling 2 at the entrance side of the other unit B. In the following description, the apparatus A at right will be referred to as the preceding unit or stage while the apparatus B at left will be referred to as the succeeding unit or stage. In FIG. 4 there are shown registration rollers 9 for positioning the leading end of the recording sheet in registration with the leading end of the latent image on unrepresented drum; a cassette 10 for supplying the recording sheets; and feeding rollers 11 for advancing a recording sheet from said cassette 10 to the registration rollers 9. Said cassette 10 is housed in the female coupling 2 of the preceding unit A.

Figure 5:
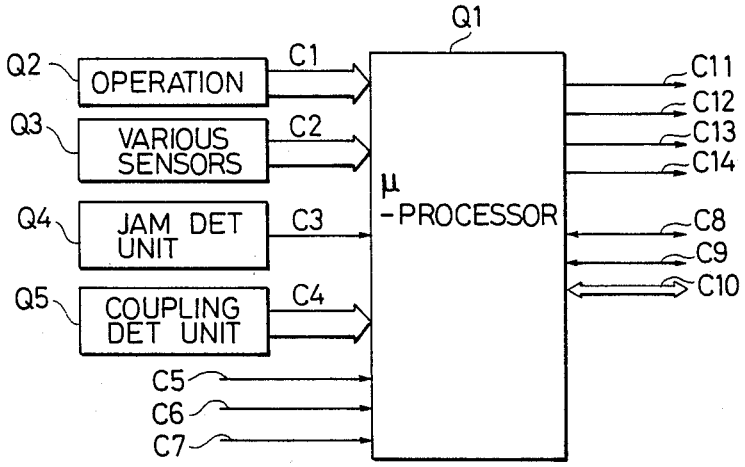
FIG. 5 is a block diagram showing an example of a control unit of the apparatus shown in FIGS. 3A and 3B.

FIG. 5 shows an example of a control unit for use in the apparatus shown in FIG. 3, wherein a microprocessor Q1 for various controls comprises a central processing unit CPU, a read-only memory ROM for storing the control programs, a random access memory RAM for data storage etc. and is composed of an already known one-chip microcomputer. There are also shown the operation panel Q2 comprising input keys and indicators as shown in FIG. 2 sensors Q3 for detecting the status of copying operation; a jam detection unit Q4 for detecting a sheet jamming; and a coupling detection unit Q5 comprising the aforementioned sensor switches 3, 4.

The microprocessor Q1 receives, as the input signals, not only key signals C1 from the operation panel Q2, detection signals C2 from the sensors Q3, detection signals C3 from the jam detection unit Q4 and detection signals C4 from the coupling detection unit Q4 which are generated within the apparatus, but also a succeeding stage jam signal C5, a succeeding stage stop signal C6, an interruption signal C7, a copy start signal C8, a copy end signal C9 and a sheet size signal C10 which are transmitted from the other apparatus through the connectors 5 and 6. These input signals are processed in the microprocessor Q1 by a predetermined sequence according to the program stored in the read-only memory ROM, and said microprocessor generates a copy disable signal C11, a pseudo sheet feed signal C12, a stop signal C13 and a jam signal C14. The combined copying operation in the mutually coupled apparatus is controlled by these input and output signals and by the data processing in the microprocessor Q1.

Now reference is made to FIGS. 6, 7A, 7B, 8, 9 and 10 for explaining the function of the apparatus of the present invention shown in FIGS. 1 to 5.

Figure 6:
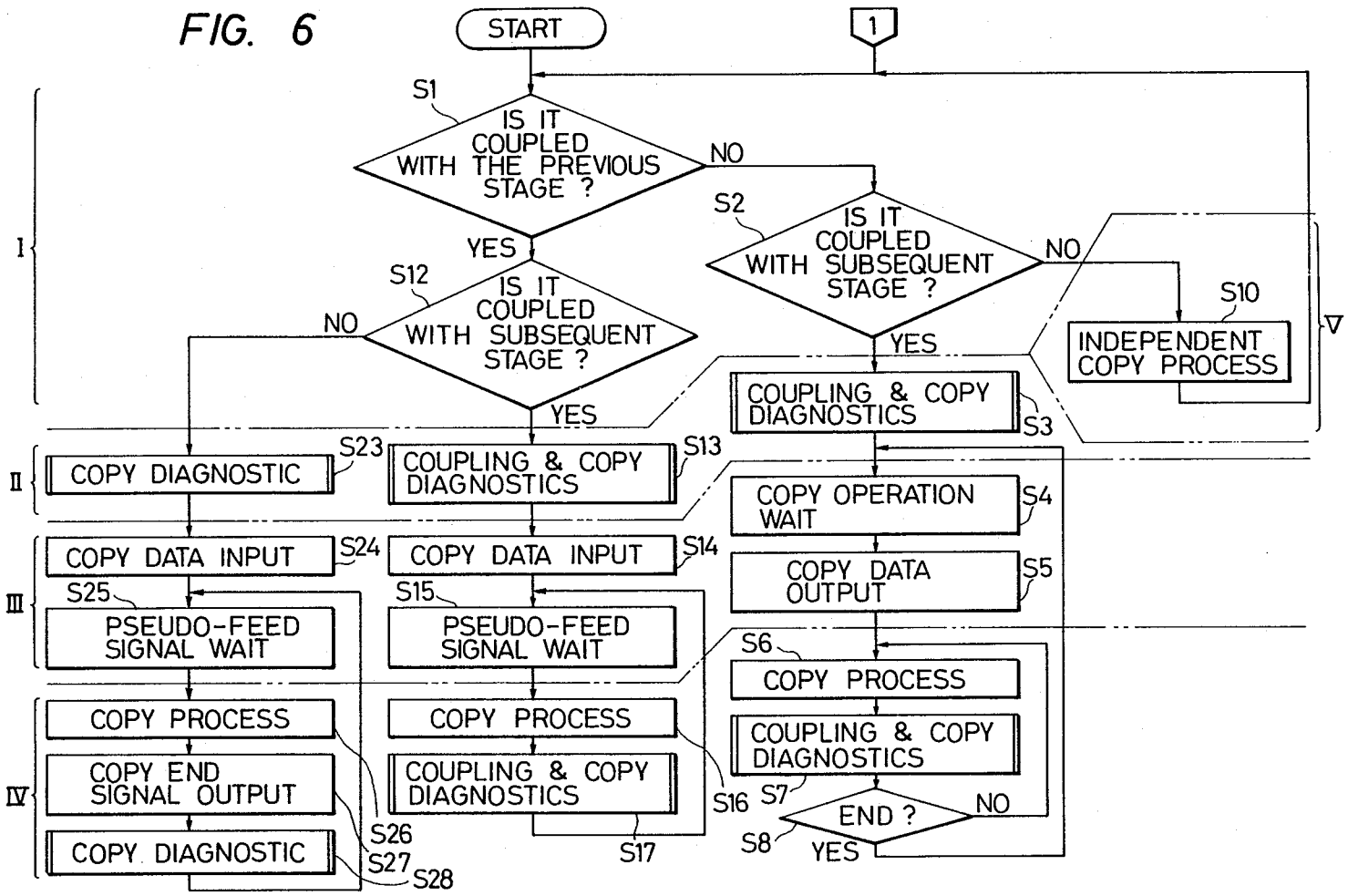
FIG. 6 is a flow chart showing an example of the control operation of the control unit shown in FIG. 5.

At first the function of each of the copiers coupled as shown in FIG. 4 will be explained while making reference to FIG. 6. It is to be noted that the status of each apparatus is classified as (1) a state of independent use, (2) a state connected a succeeding apparatus only, (3) a state connected to a preceding apparatus only, or (4) a state connected to a preceding apparatus and a succeeding apparatus. Thus, steps S1, S2 and S12 belonging to a first sequehce group discriminate the presence of coupling and the number of coupled apparatus. In the absence of coupling the steps S1 and S2 provide negative results to identify the independent status of the apparatus, whereby the program proceeds to a step S10 to initiate the function as an independent copier as already explained in relation to FIG. 1.

On the other hand, an affirmative result in the step S2 indicates a status that the apparatus is a first one connected only to a succeeding apparatus, for example the status of the unit A shown in FIG. 4, whereby the program proceeds to a step S3 belonging to a succeeding sequence group II. Affirmative results both from the steps S1 and S12 indicate a status that the apparatus is connected both to a preceding one and a succeeding one, whereby the program proceeds to a step S13 belonging to said sequence group II. Also a negative result in the step S12 indicates a status that the apparatus is a final one connected only to a preceding apparatus, for example the status of the unit B shown in FIG. 4, whereby the program proceeds to a step S23 belonging to said sequence group II. After the classification in the sequence group I, the copying process in each status proceeds in the following manner.

Figure 7A:
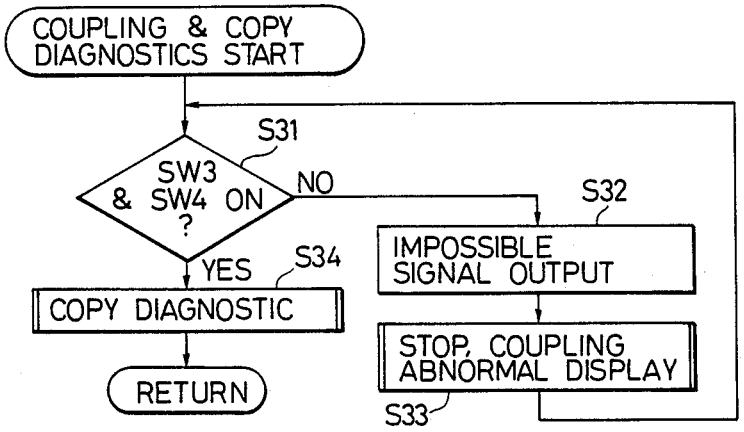
FIGS. 7A and 7B are flow charts showing coupling and copy diagnosing subroutines shown in FIG. 6.
Figure 7B:
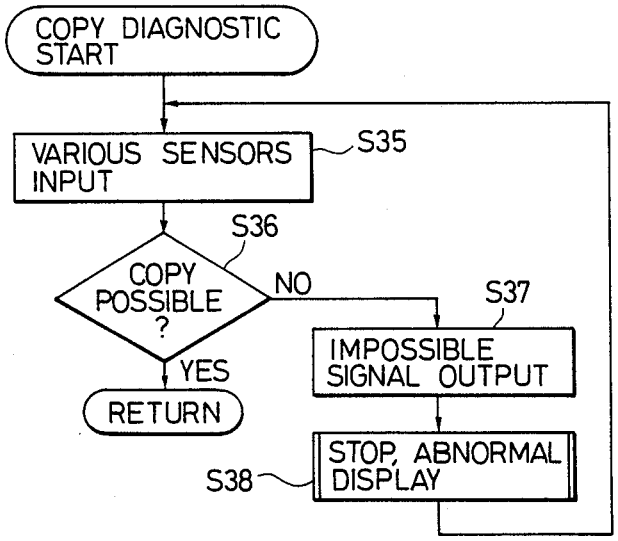
Figure 8:
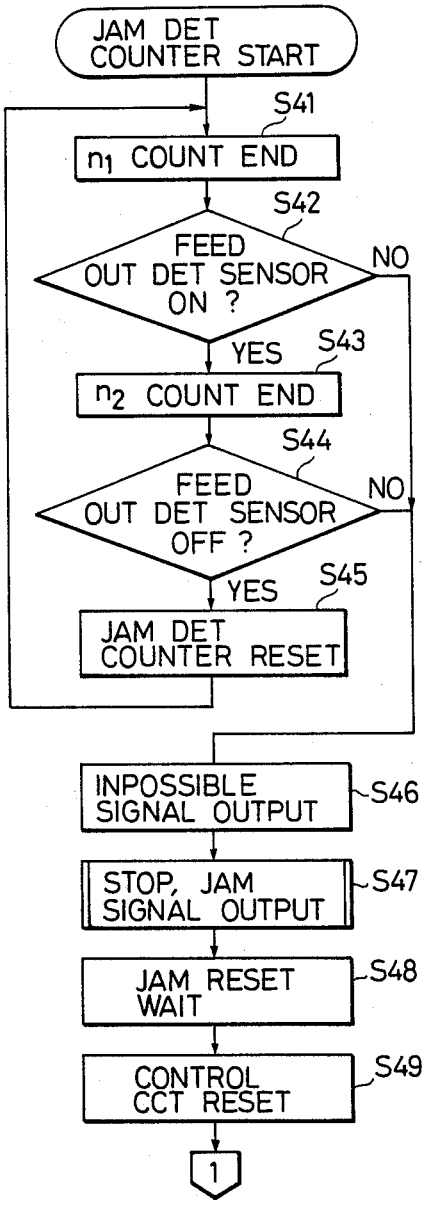
FIG. 8 is a flow chart showing an example of the jam detecting operation of the control unit shown in FIG. 5.

The step S3, S13 or S23 in the sequence group II identifies whether each apparatus is ready for copying operation, by means of a copy diagnosing subroutine or a coupling-copy diagnosing subroutine shown in FIGS. 7A and 7B.

If the apparatus is coupled with a succeeding apparatus, the program jumps from the step S3 or S13 to the coupling-copy diagnosing subroutine shown in FIG. 7A, and a step S31 inspect the status of the sensor switches 3, 4 to identify whether the mechanical coupling is complete. In case of an incomplete coupling, a step S32 releases a copy disable signal C11, then a step S33 terminates the operation and indicates the abnormality in the coupling through the indicator lamp 61, and the program returns to the step S31 to continue to inspect the coupling detection signal C4 until the switches 3, 4 are both closed, namely until the coupling is completed. In such situation said copy disable signal C11 is transmitted, as an interruption signal, to all the preceding stages, whereby, in such failure, the failed stage and all the preceding stages are stopped. This stopping procedure will be detailed afterwards in relation to FIG. 9.

When the step S31 provides an affirmative result indicating the completion of the coupling, a succeeding step S34 discriminates whether the copying operation is enabled, for example from the presende of toner and recording sheet, according to the copy diagnosing subroutine shown in FIG. 7B. In said subroutine, steps S35 and S36 discriminate whether the copying operation is enabled in response to the detection signals C2 from the sensors Q3, and, if the copying operation is disabled, a step S37.releases copy disable signal C11 in the same manner as in the aforementioned case, and a step S38 terminates the copying operation and indicates the status of abnormality. Then a step S36 continues the inspection of the status, and, when the abnormality is resolved, the program returns to the main routine. On the other hand, in an apparatus connected to a preceding stage but not to a succeeding one, for example the status of the unit B shown in FIG. 4, the step S23 executes the above-mentioned copy diagnosing subroutine only since the discrimination of the coupling is unnecessary in this case.

If the enabled state for copying operation is identified in this manner, the program proceeds to a third sequence group III for setting the copying sequence. In case of the first copier, the program proceeds from the step S3 to a step S4 for awaiting a copy instruction signal, which is generated by the actuation of the copy key 52 in the operation panel Q1, or, in an apparatus equipped with a manual feeding mechanism, by insertion of a recording sheet into the manual insertion slot. In response to said copy instruction signal, a succeeding step S5 transmits the size of the recording sheet obtained from the cassette size at the reception of said instruction signal and the copy data necessary for the copy process to all the succeeding stages. In said transmission, however, data concerning the copy number in a continuous copying operation need not be transmitted for the reason to be explained in relation to the timing chart shown in FIG. 10.

In a copier connected with a preceding stage, a step S14 or S24 receives the above-mentioned copy data to be supplied from the preceding stage, and a succeeding step S15 or S25 awaits a pseudo sheet feeding signal C12 to be supplied from the preceding stage. In this situation, entries from the keys in the operation panel, except the copy density lever 55, are not accepted. Said pseudo sheet feeding signal C12 is generated in response to a signal generated by the sheet discharge sensor 8 shown in FIGS. 1 and 3A when a recording sheet reaches said sensor 8 in the course of a copying process in the preceding stage, and the succeeding copier initiates, in response to said signal C12, a copying operation on the recording sheet transferred from the preceding apparatus.

The actual copying operation is conducted in a step S6, S16 or S26 in the fourth sequence group IV. During said copying process, constant inspection for sheet jamming is effected by a jam detecting routine shown in FIG. 8. Said jam detection is achieved by counting clock pulses synchronized for example with the rotation of the drum 21 or with the original scanning. At first a jam detection counter is set to zero, and if, upon counting pulses of a first predetermined number n1 in a step S41, the recording sheet does not reach the sheet discharge sensor 8, a step S42 identifies a delay of the recording sheet whereby the program jumps to a step S46. Also a step S43 counts pulses of a second predetermined number n2 after the sheet discharge sensor 8 is activated, and, if the recording sheet is still on the sheet discharge sensor 8 at the end of said pulse counting, a step S44 identifies the stay of the recording sheet, whereby the program jumps to the step S46. The above-mentioned number n2 however varies according to the longitudinal length of the recording sheet, and, for this reason, the size thereof has to be informed to each copier. Therefore, all the succeeding stages receive, from the first copier in the aforementioned step S14 or S24, data representing the size of the recording sheet to be transported from the first copier.

In case of a delay or stay jam as explained above, steps S46 and S47 are executed to stop the function of the apparatus, indicate the jam state by the indicator lamp 60 and release the jam signal C14 and the copy disable signal C11, thereby stopping all the stages preceding the failed copier in succession. Then a step S48 awaits a jammed sheet handling for removing the jammed sheet and a jam: resetting operation, and, after the resetting of the control circuit, the program returns from a step S49 to the initial stage in the step S1. On t:he other hand, in case the step S44 identifies a normal state, namely the absence of the delay or stay jam, the program proceeds to a step S45 for resetting the jam detection counter. Then the program returns to the step S41 to repeat the above-described procedure until the copying operation is completed.

If sheet jamming does not occur during the copying operation, each copier inspects, at each copying cycle, whether the copying operation is still enabled by means of the aforementioned copy diagnosing subroutine or coupling and copy diagnosing subroutine in a step S7, S17 or S28. In the absence of any abnormality, the first copier returns to the step S6 and repeats the steps S6 to S8 until the step S8 discriminates the completion of copying cycles of a number determined in the step S4. Thereafter the program returns to the step S4 to await the next copying operation. In a copier connected to both preceding and succeeding stages, and in the absence of any abnormality, the program returns from the step S17 to the step S15 to await the pseudo sheet feeding signal C12 from the preceding stage. In the last copier, the step S27 releases the copy end signal C9 each time the sheet discharge sensor 8 detects the passing of a recording sheet, and said signal C9 is transmitted in scccession to the first copier. The first copier can thus identify the number of the recording sheets present in the entire system, from the count of said copy end signals and the number of the recording sheets supplied. After the release of the copy end signal C9, and in the absence of any abnormality in the copy diagnosis in the step S28, the last copier returns to the step S25 to await the pseudo sheet feeding signal from the preceding stage.

Figure 9:
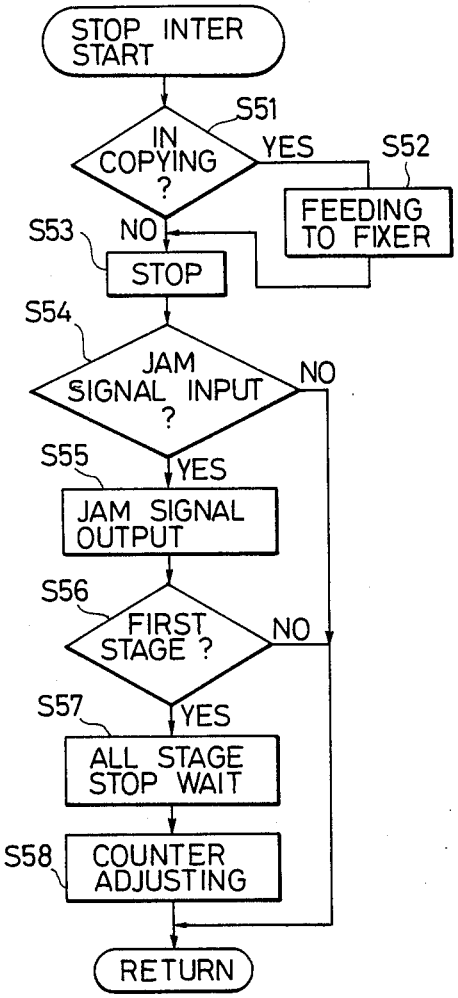
FIG. 9 is a flow chart showing an example of stopping and interrupting operation shown in FIG. 8

Now reference is made to FIG. 9 for explaining the control sequence in case an interruption signal for stopping the copiers in the aforementioned step S33, S38 or S47. When the copy disable signal C11 is released in the preceding step S32, S37 or S46, an interrupting instruction is given to all the preceding copiers thereby stopping said copiers in succession. However, if a copying process is in progress, each copier is stopped not immediately but when the recording sheet is transported to immediately in front of the fixing station in the immediately preceding stage, so that the recording sheets in the system are all positioned on the sheet conveyors (steps S51 to S53). Also the copiers succeeding the failed copier are maintained in normal operation until all the recording sheets in the system are discharged or positioned in safe places. Also in response to a jam signal from a succeeding stage, the program proceeds from a step S54 to a step S55 to release a jam signal C14. On the other hand, in the first copier, a step S57 awaits until all other copiers are stopped, then a step S58 adjusts the content of an unrepresented copy number counter provided in the control unit to an number for obtaining an appropriate copy number when the copying operation is re-started, and the program returns to the original routine and proceeds to the following sequence.

Figure 10:
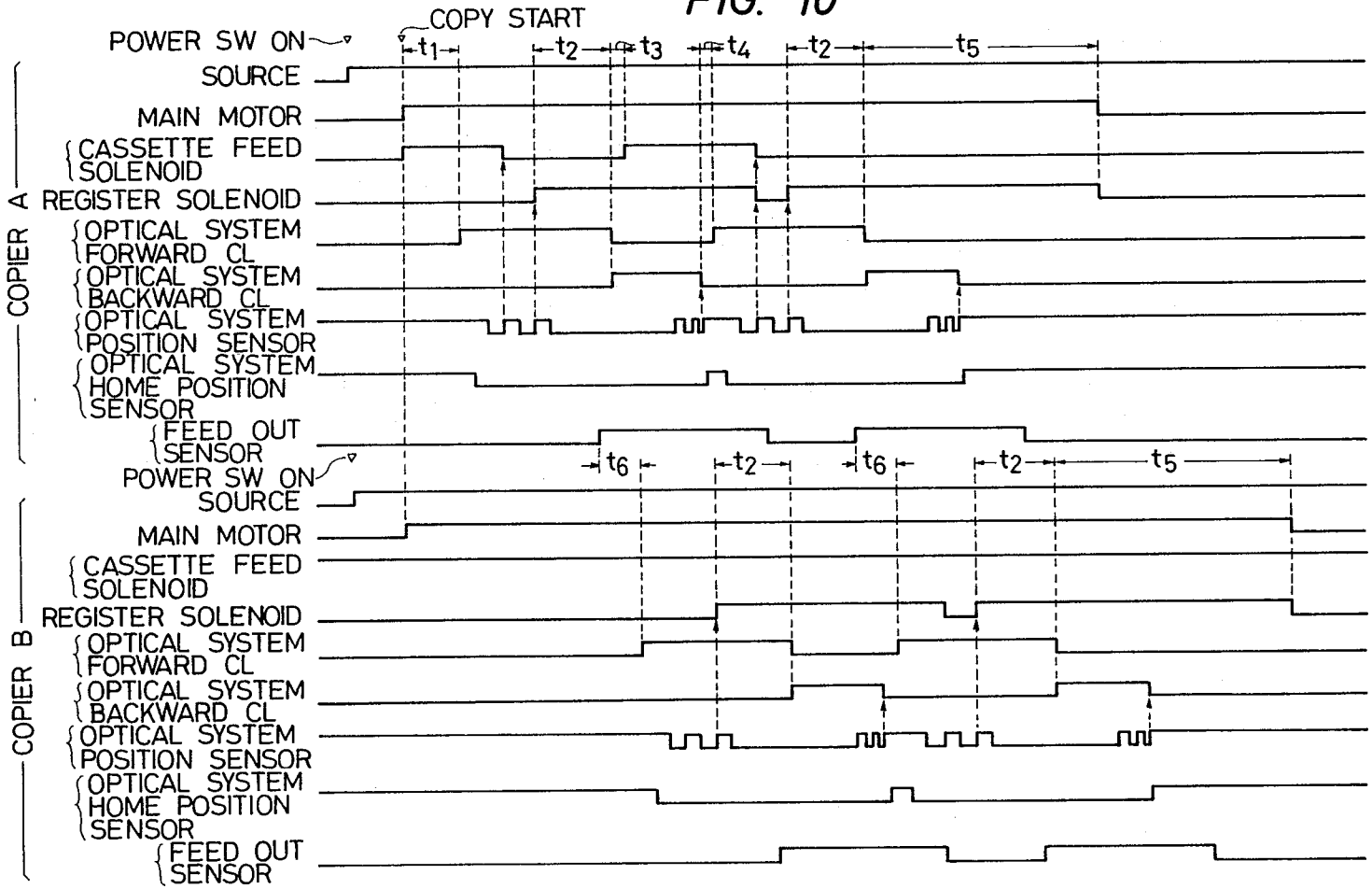
FIG. 10 is a timing chart showing output signal forms in case two copies are made in succession by two apparatus coupled as shown in FIG. 4.

FIG. 10 shows the timings of control operations when two copies are continuously made on the recording sheets supplied from the cassette 10, by means of the copiers A and B which are coupled as shown in FIG. 4 to overlay plural images on a recording sheet. In the first copier A, in response to the actuation of the copy key 51 in the operation panel Q2 after the start of power supply, the main motor is put into rotation and the cassette sheet feeding solenoid is simultaneously energized to rotate the feeding roller 11 for sheet feed from the cassette. 10. At a time t1 from the actuation of said copy key 51, the optical system starts the forward movement as explained before, and the energization of said solenoid is terminated at the start of a first pulse supplied from a pulse generating circuit of the position sensor mounted on said optical system. Then a registration solenoid is energized at the start of a second pulse to rotate the registration rollers 9, thus advancing the recording sheet toward the photosensitive drum 21.

Said optical system starts reverse motion at a time t2 from the start of rotation of the registration rollers 9, and the feeding roller 11 is rotated at a time t3 thereafter to advance the next recording sheet. When the optical system reaches the vicinity of the home position in said reverse motion, the position sensor generates a third pulse, at the start of which the optical system is stopped. In case of a single copying, the main motor and the registration rollers may simply be stopped after a determined period. However, in the continuous copying for two sheets, the forward motion of the optical system is started again at a time t4 from the stoppage of said optical system, thus initiating the second copying cycle. Said second copying cycle is substantially same as the first one, except that the main motor and the registration rollers are stopped at a time t5 from the start of reverse motion of the optical system. Thereafter the first copier A awaits the actuation of the copy key (cf. step S4 shown in FIG. 6.).

Now there will be explained the function of the second copier B for the recording sheets transferred from the first copier. The copy start signal for the first copier A is used also as the copy start signal for the second copier B, thus starting the rotation of the main motor thereof. However, in contrast to the function in the first copier A, feeding roller 11 in the second copier B is not rotated. Since the fixing rollers 7 of the first copier A functions as the feeding roller for the second copier B, the feeding roller 11 of said second copier B is not driven and is positioned so as not to touch the recording sheet. The second copier B initiates the copying operation on the recording sheet already subjected to the copying process in the first copier A, at a time t6 from the start of signal from the sheet discharge sensor 8 of the first copier A.

Subsequent operation is same as that in the first copier A except the rotation of the feeding roller 11. It will be noted that the first copier A starts the forward motion of the optical system at a time interval t4 for the second copying cycle, after the completion of the first copying cycle. On the other hand, in the second copier B in which the copying is initiated at the start of a detection signal (pseudo sheet feeding signal) from the sheet discharge sensor 8 of the first copier A, a continuous copying operation can be maintained only if said pseudo sheet feeding signal C12 is entered within the period t5 which defines the timing of stopping the main motor and the registraion roller 9 after the start of reverse motion of the optical system. For this reason the data indicating the copy number in a continuous copying operation need not be informed to the second and ensuing copiers.

Although the foregoing embodiment consists of identical copiers mutually so coupled to record plural images on a face of the recording sheet, it is also possible to couple copiers of mutually different functions. As an example both-side copying can be achieved if copiers capable of image formation on respectively different faces of the recording sheet are mutually coupled. Also such both-side copying is rendered possible by coupling plural copiers through a sheet inverting mechanism. Furthermore the apparatus to be coupled is not limited to a copier but indludes a laser beam printer, an ink jet printer, a thermal printer etc. adapted for recording in response to electric signals.

As explained in the foregoing, the present invention is featured by a structure enabling to coupling of transport path for the recording sheets as easily as the setting of the sheet cassette and also enabling, when plural apparatus are mutually connected, the control unit of an apparatus to control the copying operation of other apparatus, whereby the image editing and similar operations are faciliated and the complex functions usually achievable only with large apparatus can be realized by the combination of plural simpler apparatus.

Also the constant inspection of the coupling state allows to reduce the abnormalities apt to result in the coupling of plural apparatus, and the mutual inspection between the mutually coupled apparatus allows to interrupt the function thereof after the recording sheets are moved to safe positions in case of an abnormality, and to maintain such inactive stage until the cause of the abnormality is removed.

Also in such coupled states instructions for the copying operation can only be entered from the operation panel of a first apparatus and are used for controlling all the coupled apparatus, whereby the operating procedure is significantly simplified and errorneous actuations of the operation panels of the succeeding apparatus does not give rise to an erroneous operation.

Furthermore, in each of mutually coupled plural apparatus, the sheet feeding roller is not driven except that in the first apparatus and is replaced by the fixing rollers of the immediately preceding apparatus, and the timing of rotation of the registraion rollers is controlled by the output signal from the sheet discharge sensor of the immediately preceding apparatus. The copying operation can therefore be achieved without sheet jamming or abberation in timing.

Furthermore, in case of an abnormality in the course of imagerecording with mutually coupled plural apparatus, the apparatus succeeding to the failed apparatus are maintained in operation until the image recording operations are completed on all the recording sheets introduced prior to said abnormality, thereby minimizing the loss in the recording sheets and in the recording operation.

What we claim is:

1. An image processing system comprising:

first recording apparatus means having a manually operable first operation unit, for recording a first image on a first recording material in accordance with an operation instruction from said first operation unit;

second recording apparatus means having a manually operable second operation unit for recording a second image on a second recording material which is different from the first recording mateial in accordance with an operation instruction from said second operation unit; and means for coupling said first and second recording apparatus means so as to record the first and second images on a single recording material by combination of said first and second recording apparatus means;

wherein in the event that said first and second recording apparatus means are coupled by said coupling means, said first and second recording apparatus means are operable to perform the imagre recording in response to the operation instruction from a single one of said first and second operation units.

2. An image processing system according to claim 1 wherein said first and second operation units are adapted to enter an instruction to start image recording.

3. An image processing system according to claim 1, further comprising means for inhibiting the function of the other one of said first and second operation units, if they are coupled by said coupling means.

4. An image processing system according to claim 1, wherein in the event that said first and second recording apparatus means are coupled by said coupling means, they are operable to perform the image recording in response to an operation instruction from one of said first and second operation units included in the recording apparatus means which is to be the first to record the image on the recording material.

5. An image processing system according to claim 1, wherein said first and second operation units are adapted to enter the number of image recording times.

6. An image processing system according to claim 1, wherein said first and second recording apparatus means are operable to record the first and second images on the same side of a single recording material.

7. An image processing system according to claim 1, wherein each of said first and second recording apparatus means includes means for scanning the image of a document, and for recording on the recording material the image scanned by said scanning means.

8. An image processing system comprising:

first recording apparatus means for recording a first image on a first recording material, said first recording apparatus means including a manually operable first operation unit;

second recording apparatus means for recording a second image on a second recording material which is different from the first recording material, said second recording apparatus means including a manually operable second operation unit;

position detecting means for detecting a position of the recording material on which the first image has been recorded by said first recording apparatus means; and means for feeding the recording material, on which the first image has been recorded by said first recording apparatus means, to said second recording apparatus means so as to record the second image on the recording material by said second recording apparatus means;

wherein said first recording apparatus means initiates a recording operation to record the first image on the recording material in accordance with an operation instruction from said first operation unit, and said second recording apparatus means is operable to initiate a recording operation so as to record the second image on the recording material fed by said feeding means in accordance with a position signal from said position detecting means without an operation instruction from said seoond operation unit.

9. An image processing system according to claim 8, wherein said first recording apparatus means includes said position detecting means for detecting the position of the recording material on which the first image has been recorded, and for producing said position signal, and said second recording apparatus means is operable in response to the position signal from said position detecting means to start the recording operation on the second image.

10. An image processing system according to claim 8, wherein said first and second recording apparatus means are operable to record the first and second images on the same side of a single recording material.

11. An image processing system according to claim 8, wherein each of said first and second recording apparatus means includes means for scanning the image of a document, and for recording on the recording material the image scanned by said scanning means.

12. An image processing system comprising:

first recording apparatus means for recording a first image on a first recording material;

second recording apparatus means for recording a second image on a second recording material which is different from the first recording material;

means for coupling said first and second recording apparatus means so that said second recording apparatus can record the second image on the recording material on which the first image has been recorded by said first recording apparatus:

means for inspecting the coupling state of said first and second recording apparatus means; and means for controlling recording operations by said first and second recording apparatus means coupled to each other by said coupling means in response to an output from said inspecting means;

wherein said control means inhibits the recording operations by said first and second recording apparatus means, if said inspecting means determines the existence of an unsatisfactory coupling state, where the second image cannot be recorded on the recording material on which the first image has been recorded.

13. An image processing system according to claim 12, wherein said coupling means includes means for feeding the recording material, on which the first image has been recorded by said first recording apparatus, to said second recording apparatus.

14. An image processing system according to claim 12, wherein said inspecting means detects a position relation between said first and second recording apparatus means coupled to each other by said coupling means.

15. An image processing system according to claim 12, further comprising means for indicating the coupling state inspected by said inspecting means.

16. An image processing system according to claim 12, wherein said first and second recording apparatus means are operable to record the first and second images on the same side of a single recording material.

17. An image processing system according to claim 12, wherein each of said first and second recording apparatus means includes means for scanning the image of a document, and for recording on the recording material the image scanned by said scanning means.

18. An image processing system comprising:

first recording apparatus means for recording a first image on a first recording material, said first recording apparatus means including first detecting means for detecting an abnormality of the recording material;

second recording apparatus means for recording a second image on a second recording material which is different from the first recording material, said second recording apparatus means including second detecting means for detecting an abnormality of the recording material; and means for coupling said first and second recording apparatus means so that said second recording apparatus means can record the second image on the recording material on which the first image has been recorded, said coupling means including means for transmitting information including the size of the recording material between said first and second recording apparatus;

wherein in the event that said first and second recording apparatus means are coupled by said coupling means, said second detecting means is operable to detect an abnormality of the recording material in accordance with the size of the recording material on which the first image is recorded by said first recording apparatus means, the size being indicated by the information transmitted by said transmitting means.

19. An image processing system according to claim 18, wherein said first recording apparatus means is adapted to set a storage unit for storing a plurality of recording materials, and said first and second recording apparatus means are operable to record an image on the recording material fed from said storage unit.

20. An image processing system according to claim 18, wherein in the event that said first and second recording apparatus means are coupled by said coupling means, said transmitting means transmits the information indicating the size of the recording material to said second recording apparatus, prior to start of the image recording opertion.

21. An image processing system according to claim 18, wherein said first and second recording apparatus means are operable to record the first and second images on the same side of a single recording material.

22. An image processing system according to claim 18, wherein each of said first and second recording apparatus means includes means for scanning the image of a document, and for recording on the recording material the image scanned by said scanning means.

23. An image processing system comprising:

first recording apparatus means for recording a first image on a first recording material, said first recording apparatus including first detecting means for detecting an abnormality of the recording material;

second recording apparatus means for recording a second image on a second recording material which is different from the first recording material, said second recording apparatus including second detecting means for detecting an abnormality of the recording material;

means for feeding the recording material, on which the first image has been recorded by said first recording apparatus means, to said second recording apparatus, so as to record the second images on the recording material by said second recording apparatus means; and means for controlling the image recording by said first and second recording apparatus means in response to detection output of said first and second detecting means;

wherein said control means permits said second recording apparatus means to continue the image recording operation in execution, even if said first detecting means detects the abnormality in said first recording apparatus means.

24. An image processing system according to claim 23, wherein said second recording apparatus is operable to initiate a recording operation so as to record the second image, in response to a position signal of the recording material fed by said feeding means on which the first image has been recorded by said first recording apparatus means.

25. An image processing system according to claim 23, wherein said control means inhibits the next image recording, if said second detecting means detects the abnormality of the recording material after completion of the image recording operation by said second recording apparatus means.

26. An image processing system according to claim 23, wherein said control means inhibits both the first and second recording apparatus from performing the image recording, if said second detecting means detects the abnormality in said second recording apparatus.

27. An image processing system according to claim 23, wherein each of said first and second recording apparatus means includes means for indicating a said abnormality.

28. An image processing system according to claim 23, wherein said first and second recording apparatus means are operable to record the first and second images on the same side of a single recording material.

29. An image processing system according to claim 23, wherein each of said first and second recording apparatus means includes means for scanning the image of a document, and for recording on the recording material the image scanned by said scanning means.

* * * * *